US011056293B1

(12) United States Patent
Chen et al.

(10) Patent No.: US 11,056,293 B1
(45) Date of Patent: Jul. 6, 2021

(54) KEY STRUCTURE

(71) Applicant: Acer Incorporated, New Taipei (TW)

(72) Inventors: Hung-Chi Chen, New Taipei (TW); Cheng-Han Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/934,026

(22) Filed: Jul. 21, 2020

(30) Foreign Application Priority Data

Jan. 17, 2020 (TW) ..... 109101704

(51) Int. Cl.
*H01H 13/7073* (2006.01)

(52) U.S. Cl.
CPC ..... *H01H 13/7073* (2013.01)

(58) Field of Classification Search
CPC ..... H01H 13/14; H01H 13/705; H01H 13/52; H01H 3/125; H01H 13/04; H01H 13/20; H01H 13/85; H01H 13/7073; H01H 13/28; H01H 13/64; H01H 13/22; H01H 13/36; H01H 1/242; H01H 13/48; H01H 2235/018; H01H 2235/03; H01H 13/26; H01H 13/30
See application file for complete search history.

(56) References Cited

U.S. PATENT DOCUMENTS 4,434,338 A * 2/1984 Rood ..... H01H 1/242 200/241
4,529,848 A * 7/1985 Cherry ..... H03K 17/98 200/276.1
5,173,578 A * 12/1992 Tama ..... H01H 13/705 200/250
6,239,393 B1 * 5/2001 Hansen ..... F16F 1/08 200/276
6,326,570 B1 * 12/2001 Fujii ..... H01H 1/36 200/341

FOREIGN PATENT DOCUMENTS

| | | |
|---|---|---|
| CN | 203085418 | 7/2013 |
| CN | 206250099 | 6/2017 |
| CN | 209343971 | 9/2019 |
| TW | 201729229 | 8/2017 |
| TW | M588872 | 1/2020 |

* cited by examiner

*Primary Examiner* — Ahmed M Saeed
(74) *Attorney, Agent, or Firm* — JCIPRNET

(57) ABSTRACT

A key structure includes a base plate, a key cap, a positioning base, a positioning cover, and a spring. The key cap is disposed above the base plate and has a bottom surface. The positioning base is connected to the bottom surface of the key cap and has a positioning recess. The positioning cover is slidably connected to the positioning base, is inserted into the positioning recess, and includes a bottom portion and a side wall. The spring includes a first spring portion and a second spring portion. The first spring portion is located in the positioning recess and is in contact with the bottom surface of the key cap. The second spring portion is located in the positioning cover. The first spring portion is located on a path on which the side wall of the positioning cover slides toward the bottom surface of the key cap.

8 Claims, 3 Drawing Sheets

KEY STRUCTURE

CROSS-REFERENCE TO RELATED APPLICATION

This application claims the priority benefit of Taiwan application serial no. 109101704, filed on Jan. 17, 2020. The entirety of the above-mentioned patent application is hereby incorporated by reference herein and made a part of this specification.

BACKGROUND

Technical Field

The disclosure relates to a key structure, and in particular, to a key structure applied to a keyboard.

Description of Related Art

As a common physical input device, a keyboard is widely applied to the desktop computer, the notebook computer, or other electronic apparatuses. Generally, the keyboard includes a plurality of key structures, and a shaft body adopted in the key structure may include a mechanical shaft, a rubber dome shaft, or a spring shaft.

Taking the key structure using the spring shaft (for example, a compression spring) as an example, the design of such a key structure is mostly integrated with an elastic piece. Therefore, in the process of pressing down a key cap, the elastic piece is touched by the key cap to make a sound, thereby improving the auditory experience of a user when the user operates the key structure. However, the aforementioned sound structure design has poor structural integrity, and it is difficult to meet design requirements of product miniaturization.

SUMMARY

The invention provides a key structure which has improved structural integrity.

The invention provides a key structure, including a base plate, a key cap, a positioning base, a positioning cover, and a spring. The key cap is disposed above the base plate, where the key cap has a bottom surface facing the base plate. The positioning base is connected to the bottom surface of the key cap, and the positioning base has a positioning recess. The positioning cover is slidably connected to the positioning base, where the positioning cover is inserted into the positioning recess and the positioning cover includes a bottom portion and a side wall connected to the bottom portion. The bottom portion is in contact with the base plate. The spring includes a first spring portion and a second spring portion opposite to the first spring portion. The first spring portion is located in the positioning recess and is in contact with the bottom surface of the key cap. The second spring portion is located in the positioning cover and is in contact with the bottom portion of the positioning cover. The first spring portion is located on a path on which the side wall of the positioning cover slides toward the bottom surface of the key cap.

Based on the above, in the key structure of the invention, a sound structure design is integrated into the positioning cover and the spring, so that the key structure has improved structural integrity and can meet design requirements of product miniaturization. In particular, when the key cap is pressed down (i.e., the key cap moves toward the base plate), the positioning cover slides toward the bottom surface of the key cap, and the first spring portion of the spring makes a sound when being touched and pressed by the positioning cover, thereby improving the auditory experience of a user when the user operates the key structure.

In order to make the above features and advantages of the invention more comprehensible, embodiments are described below in detail with reference to the accompanying drawings.

DESCRIPTION OF THE EMBODIMENTS

Figure 1:
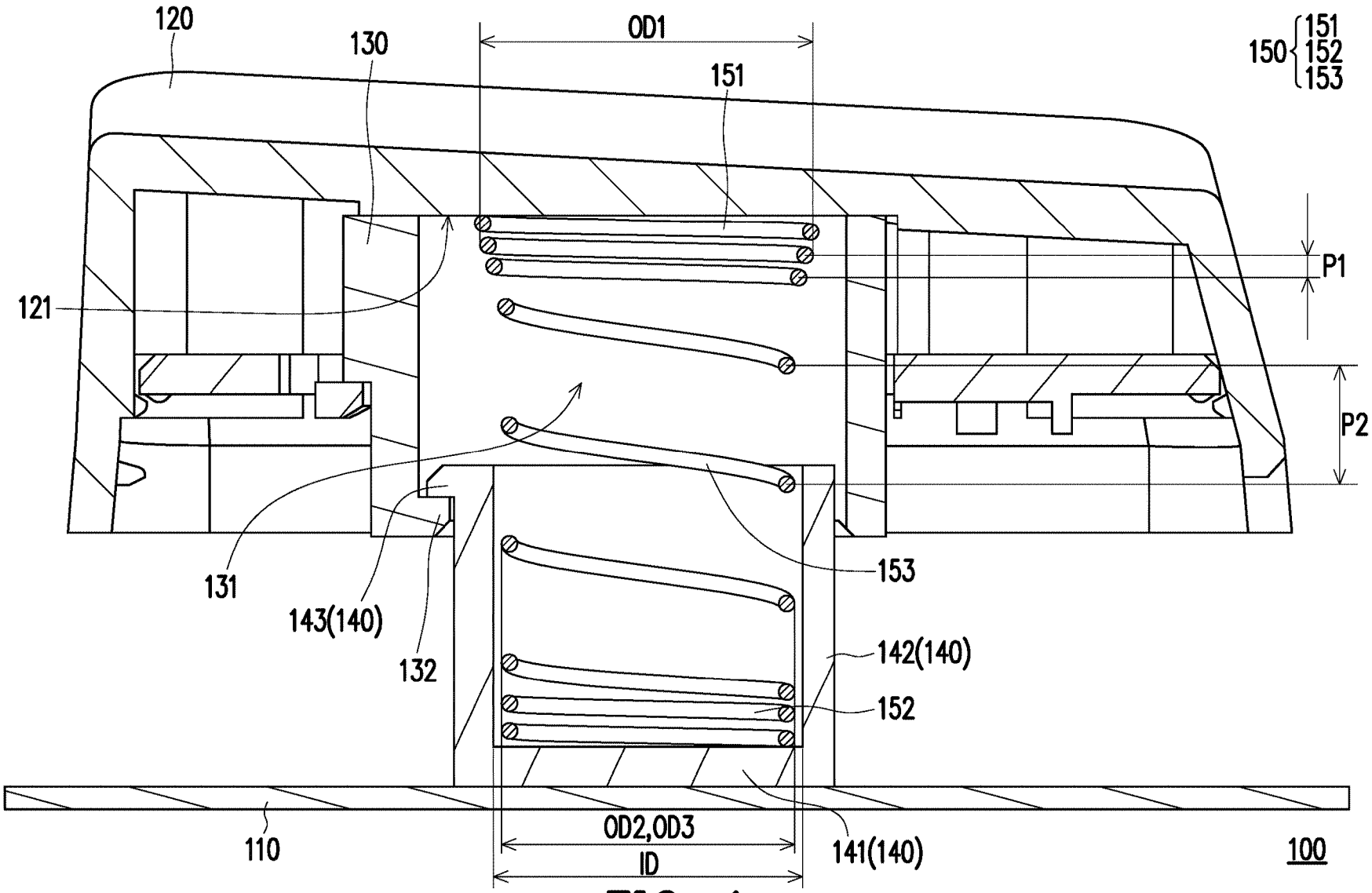
FIG. 1 is a schematic cross-sectional view of a key structure according to an embodiment of the invention.
Figure 2:
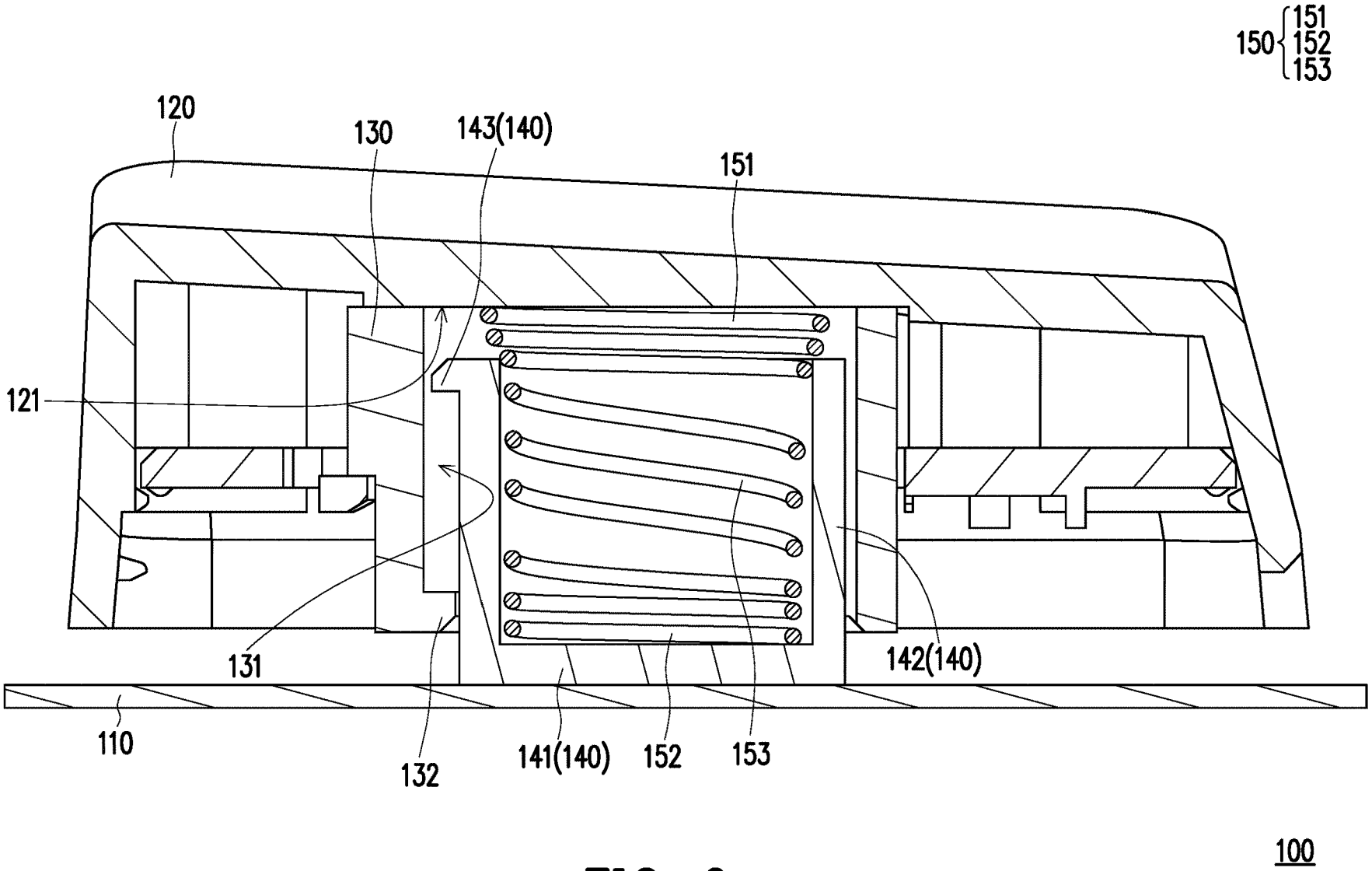
FIG. 2 is a schematic cross-sectional view of switching the key structure in FIG. 1 to another state.
Figure 3:
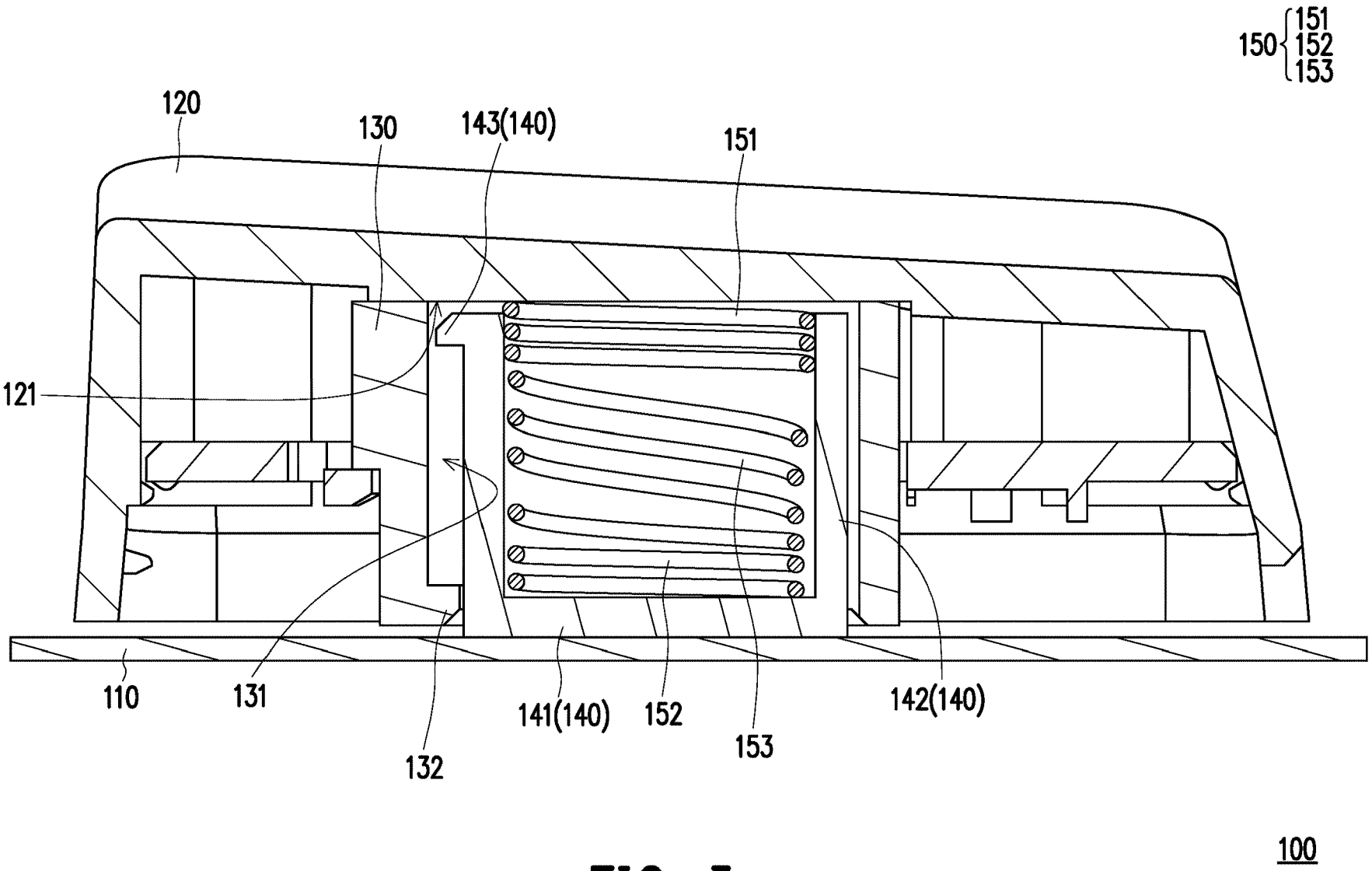
FIG. 3 is a schematic cross-sectional view of switching the key structure in FIG. 2 to a next state.

FIG. 1 is a schematic cross-sectional view of a key structure according to an embodiment of the invention. FIG. 2 is a schematic cross-sectional view of switching the key structure in FIG. 1 to another state. FIG. 3 is a schematic cross-sectional view of switching the key structure in FIG. 2 to a next state. Referring to FIG. 1, in the present embodiment, a key structure 100 may be applied to a keyboard and used as a physical operation interface for a user to input a signal to a desktop computer, a notebook computer, or other electronic apparatuses. In particular, the key structure 100 includes a base plate 110, a key cap 120, a positioning base 130, a positioning cover 140, and a spring 150. The key cap 120 is disposed above the base plate 110, and the spring 150 is configured to support the key cap 120. The spring 150 is located between the key cap 120 and the base plate 110, and is covered by the positioning base 130 and the positioning cover 140. In other words, the positioning base 130 and the positioning cover 140 are located between the key cap 120 and the base plate 110.

The key cap 120 has a bottom surface 121 facing the base plate 110, where the positioning base 130 is connected to or protrudes from the bottom surface 121 of the key cap 120, and the positioning base 130 has a positioning recess 131 for accommodating the spring 150. The positioning cover 140 is slidably connected to the positioning base 130 and is inserted into the positioning recess 131. Further, the positioning cover 140 includes a bottom portion 141 and a side wall 142 connected to the bottom portion 141, and the bottom portion 141 is in contact with the base plate 110. In addition, the spring 150 includes a first spring portion 151 and a second spring portion 152 opposite to the first spring portion 151. The first spring portion 151 is located in the positioning recess 131 and is in contact with the bottom surface 121 of the key cap 120. The second spring portion 152 is located in the positioning cover 140 and is in contact with the bottom portion 141. In other words, the spring 150 is indirectly in contact with the base plate 110 through the bottom portion 141 of the positioning cover 140.

The spring 150 may be a compression spring, and the key structure shown in FIG. 1 is in an initial state. As shown in FIG. 2 and FIG. 3, when the key cap 120 is pressed down (or the key cap 120 moves to the base plate 110), the spring 150 is pressed by the key cap 120 to cause compression deformation, and the positioning cover 140 slides toward the bottom surface 121 of the key cap 120 relative to the positioning base 130. Once downward pressure applied to the key cap 120 is removed, spring force of the spring 150 drives the key cap 120 and the positioning base 130 to move away from the base plate 110 to restore to the initial state shown in FIG. 1.

Referring to FIG. 1 to FIG. 3, the first spring portion 151 is located on a path on which the side wall 142 of the positioning cover 140 slides toward the bottom surface 121 of the key cap 120. Therefore, when the key cap 120 is pressed down (i.e., the key cap 120 moves toward the base plate 110), the positioning cover 140 slides toward the bottom surface 121 of the key cap 120, and the first spring portion 151 of the spring 150 makes a sound when being touched and pressed by the side wall 142 of the positioning cover 140, thereby improving the auditory experience of a user when the user operates the key structure 100. In other words, in the key structure 100, a sound structure design is integrated into the positioning cover 140 and the spring 150, so that the key structure has improved structural integrity and can meet design requirements of product miniaturization.

As shown in FIG. 2 and FIG. 3, after the positioning cover 140 slides toward the bottom surface 121 of the key cap 120, the first spring portion 151 is pressed by the side wall 142 of the positioning cover 140 and moves into the positioning cover 140. As shown in FIG. 1, an outer diameter OD1 of the first spring portion 151 is greater than an inner diameter ID of the positioning cover 140, so as to ensure that the positioning cover 140 after sliding toward the bottom surface 121 of the key cap 120 can touch and press the first spring portion 151. In addition, the outer diameter OD1 of the first spring portion 151 gradually expands toward the bottom surface 121 of the key cap 120, and the outer diameter OD1 of the first spring portion 151 is greater than an outer diameter OD2 of the second spring portion 152. Further, the first spring portion 151 includes a plurality of coils, an outer diameter of one of the coils that is in contact with the bottom surface 121 of the key cap 120 is the largest, and an outer diameter of the other of the coils closest to the second spring portion 152 is the smallest.

Referring to FIG. 1 to FIG. 3, in the present embodiment, the spring 150 further includes a third spring portion 153 located between the first spring portion 151 and the second spring portion 152, the third spring portion 153 extending from the positioning recess 131 of the positioning base 130 into the positioning cover 140. After the positioning cover 140 slides toward the bottom surface 121 of the key cap 120, the first spring portion 151 and the third spring portion 153 move into the positioning cover 140.

In particular, the outer diameter OD2 of the second spring portion 152 is equal to an outer diameter OD3 of the third spring portion 153, the outer diameter OD1 of the first spring portion 151 being greater than the outer diameter OD3 of the third spring portion 153, and the outer diameter OD2 of the second spring portion 152 and the outer diameter OD3 of the third spring portion 153 being less than the inner diameter ID of the positioning cover 140.

The third spring portion 153 is configured to connect the first spring portion 151 and the third spring portion 153. The third spring portion 153 includes a plurality of coils, a pitch of any two adjacent coils of these coils being P2. In addition, the first spring portion 151 includes a plurality of coils, a pitch of any two adjacent coils of these coils being P1. In particular, the pitch P2 of the third spring portion 153 is greater than the pitch P1 of the first spring portion 151. When the key cap 120 is pressed down (or the key cap 120 moves toward the base plate 110), the first spring portion 151 and the third spring portion 153 are main deformation regions of the spring 150.

Based on the above, compared with the first spring portion 151, the third spring portion 153 is more susceptible to compression and deformation, so that segmented (or two-stage) operation feeling can be fed back to the user. In addition, because the outer diameter OD1 of the first spring portion 151 gradually expands toward the bottom surface 121 of the key cap 120, when the key cap 120 is pressed down (or the key cap 120 moves to the base plate 110), the first spring portion 151 is retracted under force, to feed back special operation feeling to the user.

Referring to FIG. 1 to FIG. 3, in the present embodiment, the positioning base 130 includes a first positioning convex portion 132 away from the bottom surface 121 of the key cap 120, orthographic projection of the first positioning convex portion 132 on the bottom surface 121 of the key cap 120 falling within the positioning recess 131. In addition, the positioning cover 140 further includes a second positioning convex portion 143 protruding from the side wall 142 and away from the bottom portion 141, the second positioning convex portion 143 being slidably disposed in the positioning recess 131 and being configured to slide between the bottom surface 121 of the key cap 120 and the first positioning convex portion 132. Further, the first positioning convex portion 132 is located on a path on which the second positioning convex portion 143 slides away from the bottom surface 121 of the keycap 120, so that the positioning cover 140 can be prevented from detaching from the positioning base 130.

In view of the above, in the key structure of the invention, a sound structure design is integrated into the positioning cover and the spring, so that the key structure has improved structural integrity and can meet design requirements of product miniaturization. In particular, when the key cap is pressed down (i.e., the key cap moves toward the base plate), the positioning cover slides toward the bottom surface of the key cap, and the first spring portion of the spring makes a sound when being touched and pressed by the positioning cover, thereby improving the auditory experience of a user when the user operates the key structure.

Although the invention has been disclosed as above with the embodiments, it is not intended to limit the invention. A person with ordinary knowledge in the technical field can make some changes and decorations without departing from the spirit and scope of the invention. Therefore, the scope of protection of the invention shall be determined by the scope of the attached patent application.

What is claimed is:

1. A key structure, comprising: a base plate; a key cap disposed above the base plate, wherein the key cap comprises a bottom surface facing the base plate; a positioning base connected to the bottom surface of the key cap and comprising a positioning recess; a positioning cover slidably connected to the positioning base, wherein the positioning cover is inserted into the positioning recess, and the positioning cover comprises a bottom portion and a side wall connected to the bottom portion, wherein the bottom portion is in contact with the base plate; and a spring comprising a first spring portion and a second spring portion opposite to the first spring portion, wherein the first spring portion is boated in the positioning recess and is in contact with the bottom surface of the key cap, the second spring portion is located in the positioning cover and is in contact with the bottom portion of the positioning cover, and the first spring portion is located on a path on which the side wall of the positioning cover slides toward the bottom surface of the key cap; wherein an outer diameter of the first spring portion is greater than an inner diameter of the positioning cover.

2. The key structure according to claim 1, wherein an outer diameter of the first spring portion is greater than an outer diameter of the second spring portion.

3. The key structure according to claim 1, wherein an outer diameter of the first spring portion gradually expands toward the bottom surface of the key cap.

4. The key structure according to claim 1, wherein the spring further comprises a third spring portion located between the first spring portion and the second spring portion, and the third spring portion extends from the positioning recess of the positioning base into the positioning cover.

5. The key structure according to claim 4, wherein an outer diameter of the first spring portion is greater than an outer diameter of the third spring portion.

6. The key structure according to claim 4, wherein a pitch of the third spring portion is greater than a pitch of the first spring portion.

7. The key structure according to claim 4, wherein an outer diameter of the second spring portion is equal to an outer diameter of the third spring portion, and the outer diameter of the second spring portion and the outer diameter of the third spring portion are less than an inner diameter of the positioning cover.

8. The key structure according to claim 1, wherein the positioning base comprises a first positioning convex portion away from the bottom surface of the key cap, and the positioning cover further comprises a second positioning convex portion protruding from the side wall and away from the bottom portion, wherein the second positioning convex portion is slidably disposed in the positioning recess, and the first positioning convex portion is located on a path on which the second positioning convex portion slides away from the bottom surface of the key cap.

* * * * *